US007924121B2

(12) United States Patent
Caporaso et al.

(10) Patent No.: US 7,924,121 B2
(45) Date of Patent: Apr. 12, 2011

(54) DISPERSION-FREE RADIAL TRANSMISSION LINES

(75) Inventors: George J. Caporaso, Livermore, CA (US); Scott D. Nelson, Patterson, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 347 days.

(21) Appl. No.: 12/144,274

(22) Filed: Jun. 23, 2008

(65) Prior Publication Data

US 2008/0315801 A1 Dec. 25, 2008

Related U.S. Application Data

(60) Provisional application No. 60/936,895, filed on Jun. 21, 2007.

(51) Int. Cl.
*H01P 3/10* (2006.01)
*H05H 9/00* (2006.01)

(52) U.S. Cl. ..... 333/236; 333/34; 315/500

(58) Field of Classification Search ..... 333/236, 333/242, 248, 33, 34, 35; 315/500, 505, 315/507, 111.61
See application file for complete search history.

(56) References Cited

U.S. PATENT DOCUMENTS 2,825,760 A * 3/1958 Clogston ..... 178/45
4,441,091 A * 4/1984 Nishida et al. ..... 333/242
5,757,146 A 5/1998 Carder
5,821,705 A * 10/1998 Caporaso et al. ..... 315/507
6,573,813 B1 * 6/2003 Joannopoulos et al. ..... 333/242
7,173,385 B2 * 2/2007 Caporaso et al. ..... 315/505

OTHER PUBLICATIONS

R.A. Petr et al, "Investigation of a radial transmission line transformer for high-gradient particle accelerators," The University of Texas at Arlington, Center for Energy Conversion Research. Publication Sep. 22, 1987. pp. 132-136. XP002500517.
S.D. Nelson et al, "Electromagnetic Simulataions of Linear Proton Accelerator Structures Using Dielectric Wall Acclerators." Proceeding of PAC07, Albuquerque, New Mexico, USA. 2007 IEEE Particle Accelerator Conference. pp. 1784-1786. XP002500518.
Ian Smith, "Linear Induction Accelerators Made From Pulse-Line Cavities With External Pulse Injection". Ian Smith Incorporated, Alameda, California 94501. Rev. Sci. Instrum. 50(6), Jun. 1979. 1979 American Institute of Physics. pp. 714-718.

(Continued)

*Primary Examiner* — Benny Lee
*Assistant Examiner* — Alan Wong
(74) *Attorney, Agent, or Firm* — James S. Tak

(57) ABSTRACT

A dispersion-free radial transmission line ("DFRTL") preferably for linear accelerators, having two plane conductors each with a central hole, and an electromagnetically permeable material ("EPM") between the two conductors and surrounding a channel connecting the two holes. At least one of the material parameters of relative magnetic permeability, relative dielectric permittivity, and axial width of the EPM is varied as a function of radius, so that the characteristic impedance of the DFRTL is held substantially constant, and pulse transmission therethrough is substantially dispersion-free. Preferably, the EPM is divided into concentric radial sections, with the varied material parameters held constant in each respective section but stepwise varied between sections as a step function of the radius. The radial widths of the concentric sections are selected so that pulse traversal time across each section is the same, and the varied material parameters of the concentric sections are selected to minimize traversal error.

12 Claims, 9 Drawing Sheets

OTHER PUBLICATIONS

Ian Smith, "Induction Voltage Adders and the Induction Accelerator Family". 2004 The American Physical Society. Physical Review Special Topics—Accelerators and Beams, vol. 7, 064801 (2004).

Jaleel Akhtar, "Controlled Resolution Reconstruction of One-Dimensional Permittivity Profiles". Dissertation, Sep. 3, 2003. pp. 6-205.

* cited by examiner

DISPERSION-FREE RADIAL TRANSMISSION LINES

CROSS-REFERENCE TO RELATED APPLICATIONS

This application claims priority in provisional application No. 60/936,895, filed on Jun. 21, 2007, entitled "Dispersion-Free Radial Transmission Lines" by George J. Caporaso et al, incorporated by reference herein.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to transmission lines, and more particularly to radial transmission lines having a characteristic impedance that is held substantially constant over the radius by varying one or more of three material parameters of an electromagnetically permeable material as functions of the radius: relative magnetic permeability $\mu$, the relative dielectric permittivity $\in$, and axial width $\omega$, so that pulse transmission is substantially dispersion-free.

BACKGROUND OF THE INVENTION

Radial transmission line structures are known, such as for use in linear accelerators, and are considered desirable in that they can be constructed without the need for a magnetically permeable core. One example of a radial transmission line is shown in U.S. Pat. No. 5,757,146 to Carder, having a series of stacked circular modules each comprising an asymmetric Blumlein to generate a pulse along a central beam tube of a dielectric wall accelerator. One of the disadvantages, however, of a radial transmission line is the variable impedance of the line (variation with radius) and consequent distortion and dispersion of an output pulse. In accelerators applications, variable impedance can affect beam quality and performance by preventing proper beam transport, i.e. preventing a defined time independent energy gain from being imparted to a charged particle beam traversing the electric field. One known method of producing constant impedance with radius in such radial transmission lines involves varying the axial width of the radial line in proportion to the radius. This has been performed on the RADLAC accelerator built at Sandia National Laboratory in Albuquerque, N. Mex.

SUMMARY OF THE INVENTION

One aspect of the present invention includes a radial transmission line, comprising: a first plane conductor having a first central hole; a second plane conductor spaced from and in parallel with the first plane conductor, and having a second central hole aligned with the first central hole; and an electromagnetically permeable material that fills the space separating the first and second plane conductors to form a central channel connecting the first and second central holes, said material having the material parameter of relative magnetic permeability varied as a function of radius so that the characteristic impedance of the radial transmission line is substantially constant and pulse transmission through the radial transmission line is substantially dispersion-free.

Another aspect of the present invention includes a radial transmission line, comprising: a first plane conductor having a first central hole; a second plane conductor spaced from and in parallel with the first plane conductor, and having a second central hole aligned with the first central hole; and an electromagnetically permeable material that fills the space separating the first and second plane conductors to form a central channel connecting the first and second central holes, said material comprising a plurality of concentric radial sections with at least one of the material parameters of relative magnetic permeability $\mu$, relative dielectric permittivity $\in$, and axial width $\omega$ constant in each respective section but stepwise varied from section to section as a step function of radius r, so that the characteristic impedance Z(r) of the radial transmission line is substantially constant according to $$Z(r) = 60\sqrt{\frac{\mu(r)}{\varepsilon(r)}}\,\frac{w(r)}{r},$$

and pulse transmission through the radial transmission line is substantially dispersion-free.

BRIEF DESCRIPTION OF THE DRAWINGS

The accompanying drawings, which are incorporated into and form a part of the disclosure, are as follows.

DETAILED DESCRIPTION

Figure 1:
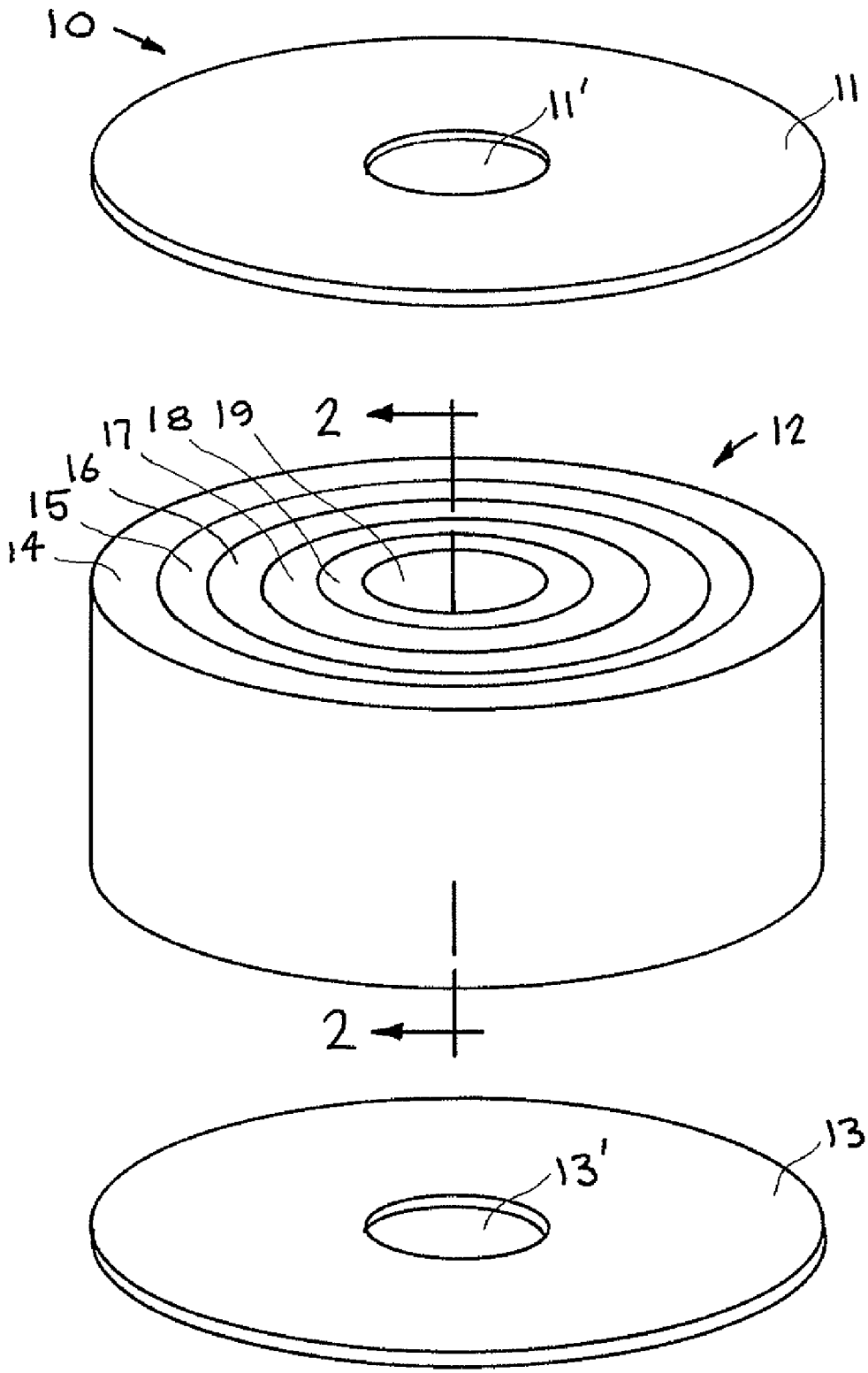
FIG. 1 is an exploded perspective view of an illustrative embodiment of the radial transmission line of the present invention, showing the concentric radial sections of an electromagnetically permeable material between two plane conductors.

The present invention is a radial transmission line that is capable of substantially dispersionless pulse propagation by holding the characteristic impedance substantially constant with radius. This is achieved in the present invention by varying at least one of the following material parameters of relative magnetic permeability μ, relative dielectric permittivity ∈, and axial width ω, as a function of radius r, and in a manner that keeps characteristic impedance Z(r) constant according to the equation:

$$Z(r) = 60\sqrt{\frac{\mu(r)}{\varepsilon(r)}}\,\frac{w(r)}{r} \qquad \text{(Eq. 1)}$$

Any combination of variations of μ, ∈, ω, as a function of radius r that makes Z(r) constant in Eq. 1 will result in a dispersionless transmission line. Several illustrative examples are described as follows.

In a first illustrative example, only the axial width ω(r) may be varied as a function of radius while the relative dielectric permittivity ∈, and the relative magnetic permeability μ are constant. In this case, a function such as ω(r)=kr may be chosen to vary axial width alone, so that characteristic impedance Z(r) will be constant according to the equation:

$$Z(r) = 60k\sqrt{\frac{\mu}{\varepsilon}}. \qquad \text{(Eq. 2)}$$

In another illustrative example, only the relative dielectric permittivity ∈ may be varied as a function of radius, while the relative magnetic permeability μ and the axial width ω are constant. In this case, a function such as $$\varepsilon(r) = \frac{k}{r^2}$$

where k is a constant, may be chosen to vary permittivity alone, so that the characteristic impedance Z(r) will be constant according to the equation:

$$Z(r) = 60\sqrt{\frac{\mu}{k}}\,w. \qquad \text{(Eq. 3)}$$

In another illustrative example, only the relative magnetic permeability μ(r) may be varied as a function of radius, while the relative dielectric permittivity ∈ and the axial width ω are constant. In this case, a function such as $\mu(r)=kr^2$ where k is a constant, may be chosen so that the characteristic impedance Z(r) will be constant according to the equation:

$$Z(r) = 60\sqrt{\frac{k}{\varepsilon}}\,w. \qquad \text{(Eq. 4)}$$

And in another illustrative example, all three material parameters of relative magnetic permeability μ(r), the axial width ω(r), and the relative dielectric permittivity ∈(r) may be varied as a function of radius. In this case, three separate functions may be chosen for the three material parameters so that Z(r) is constant. For example, $$\mu(r) = \alpha r^{1/2},\ w(r) = \beta r^{1/4},\ \text{and}\ \varepsilon(r) = \frac{k}{r},$$

results in the characteristic impedance Z(r) to be defined by the equation:

$$Z(r) = 60\sqrt{\frac{\alpha}{k}}\,\beta. \qquad \text{(Eq. 5)}$$

While in the present invention, variations of the three material parameters as functions of radius may be in a continuous manner, as represented by the continuous equations Eqs. 2-5 above, preferably the variations are achieved in a stepwise manner using discrete radial sections having specific values of the three material parameters (as described next), to produce a smooth, flat output pulse. In particular, variation of μ(r) or ∈(r) is preferably accomplished by stepwise varying the material parameters as a step function of radius. For example, a range of relative permittivity from 3 to 40 can be very accurately attained by using ten different discrete concentric rings of different permittivity to form the radial transmission line. The number and varied material parameter values of the respective concentric radial sections are chosen so as to accurately approximate the smooth analytic variation. In this manner, substantially dispersion-free radial pulse generating lines such as Blumleins, zero integral pulse (ZIP) lines and isolated Blumleins, for example, may be realized.

Figure 2:
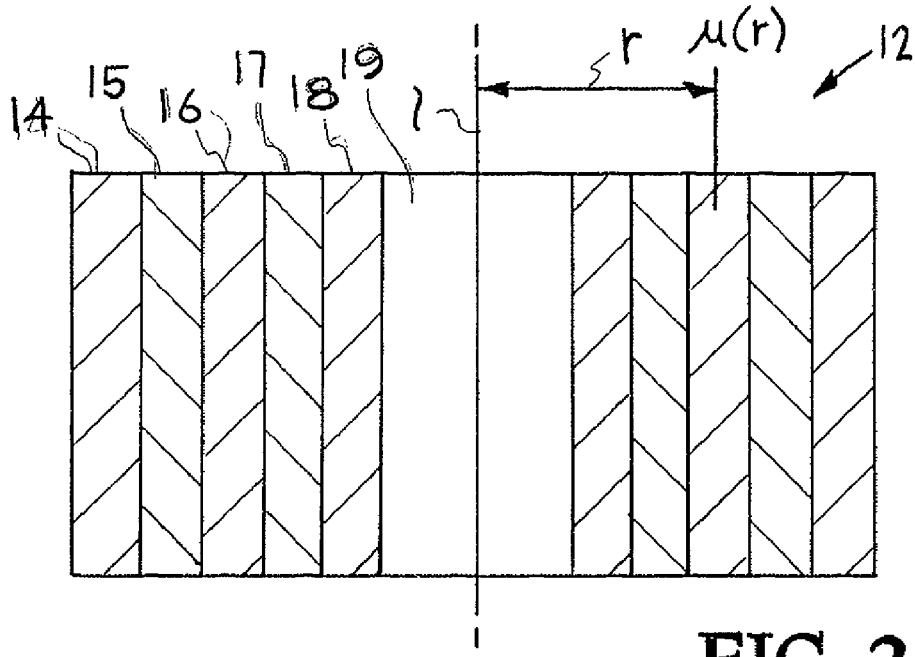
FIG. 2 is a cross-sectional view taken along line 2-2 in FIG. 1, showing the step-wise variation of the relative magnetic permeability from section to section of the electromagnetically permeable material as a step function of radius.

Turning now to the drawings, FIGS. 1 and 2 show a first exemplary embodiment of the radial transmission line of the present invention, generally indicated at reference character 10. In particular, FIG. 1 is an exploded perspective view showing the concentric radial sections of an electromagnetically permeable material 12 positioned between two plane conductors 11 and 13. The plane conductors 11 and 13 have center holes 11' and 13', respectively, and the material 12 fills the space between the two conductors so as to form a center channel 19 which connects the two center holes 11' and 13'. It is appreciated that electromagnetically permeable materials are those materials known in the art having some level of magnetic permeability, i.e. capacity of a material to be magnetized responding linearly to an applied magnetic field. As such, dielectrics are generally not suitable for the present invention.

The material 12 is shown having multiple concentric radial sections 14-18, with an innermost section 18 surrounding the center channel 19, and an outermost section 14 forming the outer perimeter of the radial transmission line. FIG. 2 is a cross-sectional view taken along line 2-2 in FIG. 1, showing the variation of the relative magnetic permeability $\mu(r)$ as a function of radius (r), shown referenced from a central axis l. In particular, the relative magnetic permeability is shown varying in a stepwise manner from section to section as a step function of radius, with the permeability being constant in each section.

Figure 3:
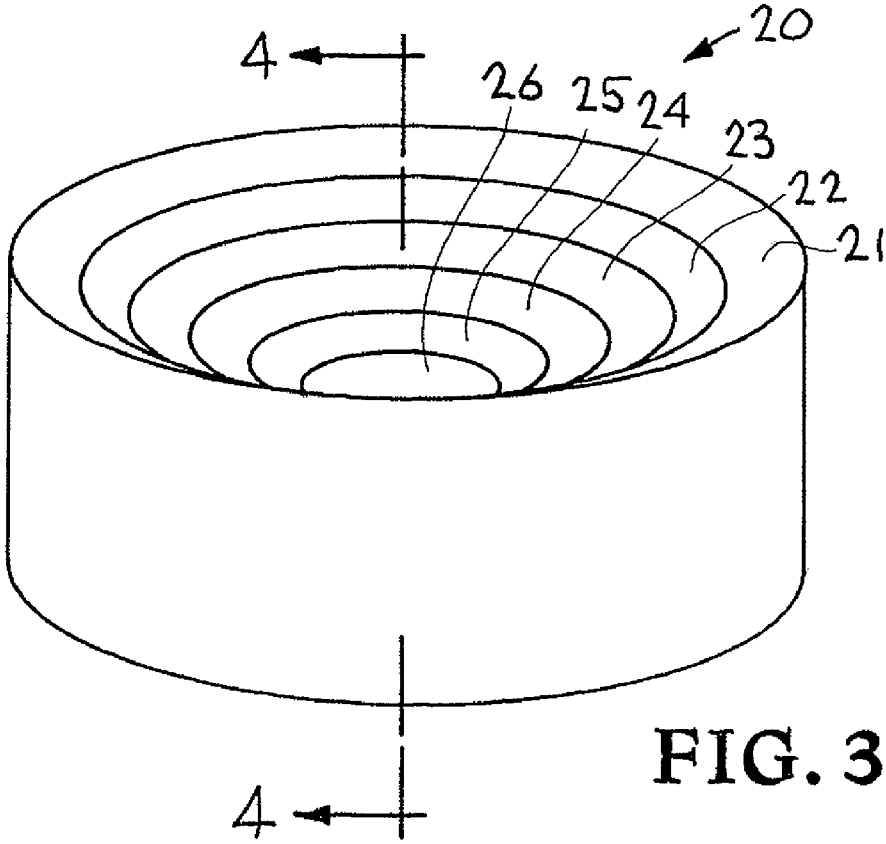
FIG. 3 is a perspective view of another illustrative embodiment of the electromagnetically permeable material of the radial transmission line of the present invention having concentric radial sections and with axial width also varied as a function of radius.
Figure 4:
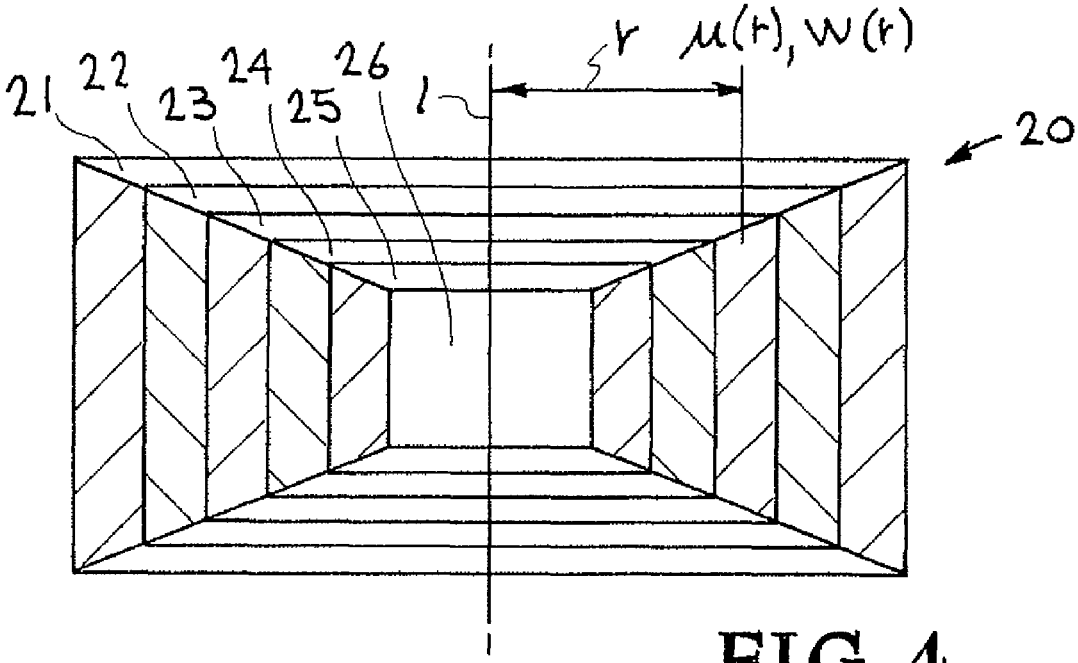
FIG. 4 is a cross-sectional view taken along line 4-4 in FIG. 3, showing the variation of axial length as a function of radius, and the step-wise variation of the relative magnetic permeability from section to section as a step function of radius.

FIGS. 3 and 4 together show another illustrative embodiment of an electromagnetically permeable material 20 of the radial transmission line of the present invention having concentric radial sections, and additionally having axial width also varied as a function of radius. In particular, FIG. 3 shows a perspective view of the material 20, while FIG. 4 is a cross-sectional view taken along line 4-4 in FIG. 3. Similar to FIGS. 1 and 2, the material 20 also is shown having a plurality of concentric radial sections 21-25, and surrounding a central channel 26. As best shown in FIG. 4, in addition to the stepwise variation of relative permeability, the axial width is also varied as a function of radius. In particular, the variation is shown as a tapering of the axial width such that an outermost radial section 21 has the largest axial width, while an innermost radial section 25 has the smallest axial width. While FIG. 4 shows that the axial width is not constant in each radial section, i.e. has a continuous taper, the present invention is not limited only to such. While not shown in the figures, the variation of axial width as a function of radius may also be in a stepwise manner over radius. In particular, the axial width may be constant in each section, but stepwise varying from section to section as a step function of radius.

Figure 5:
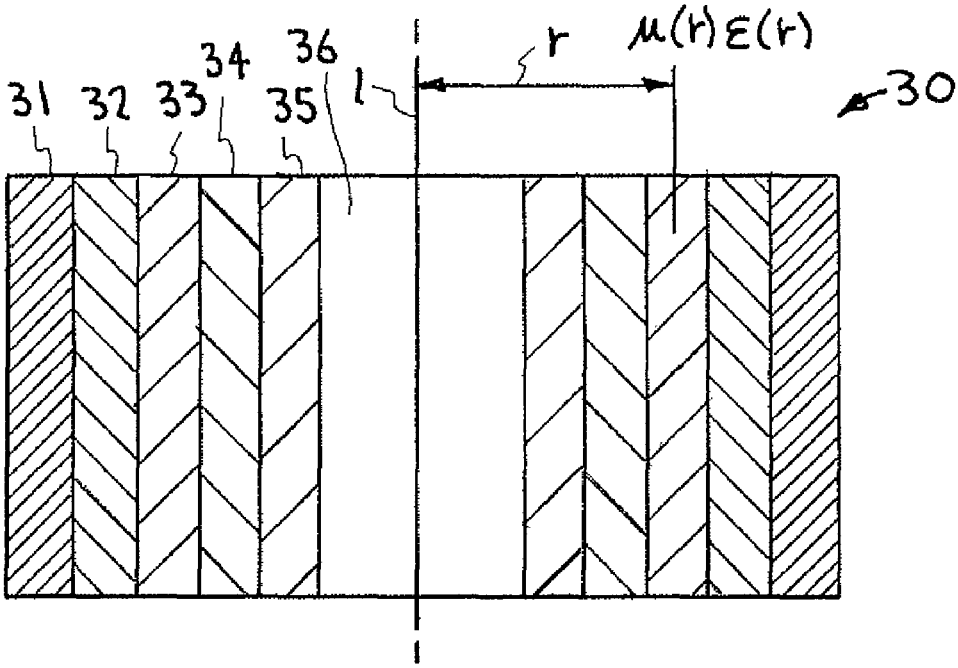
FIG. 5 is a cross-sectional view similar to FIG. 2, showing the step-wise variation of both the relative magnetic permeability and the relative dielectric permittivity from section to section as a step function of radius.

FIG. 5 is a cross-sectional view similar to FIG. 2 of electromagnetically permeable material 30 having concentric radial sections 31-35 and surrounding central channel 36. In particular, FIG. 5 shows the step-wise variation of both the relative magnetic permeability $\mu(r)$ and the relative dielectric permittivity $\in(r)$ from section to section as a step function of radius. Variation of the permeability is shown by sectional variations in the cross-hatching, while variation of the permittivity is shown by differences in shading.

Figure 6:
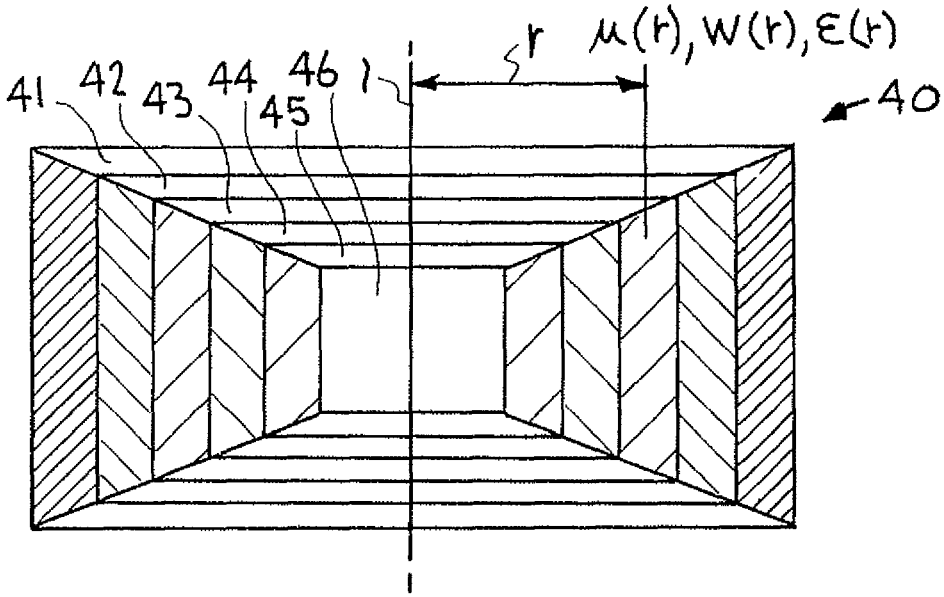
FIG. 6 is a cross-sectional view similar to FIG. 2, showing the step-wise variation of both the relative magnetic permeability and the relative dielectric permittivity from section to section as a step function of radius, as well as the variation of axial length as a function of radius.

And FIG. 6 is a cross-sectional view similar to FIG. 2 of electromagnetically permeable material 40 having concentric radial sections 41-45 and surrounding central channel 46. In particular, FIG. 6 shows the step-wise variation of both the relative magnetic permeability and the relative dielectric permittivity from section to section as a step function of radius. In addition, the axial length is also shown varied as a function of radius, although not in a stepwise manner.

The dispersion free radial transmission line of the present invention is naturally specified by adjusting material parameters in a continuous sense; e.g. parameters specifying the material properties and dimensions are varied in a continuous fashion, and represented by a continuous function such as for example Equations 2-5 above. However, the series of discrete concentric radial sections such as described for FIGS. 1-6, may be used to facilitate fabrication. The method of transitioning from the continuous parameters to the discrete parameters used in the concentric radial sections embodiment of the present invention involves the following generalized methodology, which is preferably implemented using a computer as known in the art, including a display for displaying the calculated results to, for example, a radial transmission line designer.

Generally, the method of designing the concentric radial sections is as follows. First the minimum and maximum values obtainable for the material parameters are selected, one of the maximum or minimum radius is selected, and the number of segments N is selected. The initially selected minimum and maximum values obtainable for the material parameters may or may not be later adjusted as determined by the algorithm. Depending on what parameter is varied, a corresponding continuous function and curve is chosen and calculated, as discussed with respect to Equations 2-5. Using a segmentation with N radial segments, there are N+1 points on the continuous curve that are used for the calculation. Using wave velocity as a function of radius v(r), the radius as a function of time r(t) is inverted to determine time as a function of radius, t(r). The varied material parameters are then set at the starting value ($r=r_{min}$) for $\in=\in_{max}$ and/or $\mu=\mu_{min}$. The radial widths of the concentric radial sections are then dimensioned so that pulse traversal time across each section is the same. The varied materials parameter values for each radial section are also determined. This is the final end-point correction for adjusting the initially chosen values of the varied material parameters. And having pre-selected the continuous curve of the varied material parameter as a function of radius, for each radial section, the integral of the curve above the section's varied material parameter value is set equal to the integral of the curve below the section's varied material parameter value, so as to minimize the traversal error. Next, the minimum and maximum material parameters are adjusted. The method next returns to the step of calculating the continuous function and curve, such that the resultant minimum and maximum material parameters are the same as those actually obtainable.

Figure 11A:
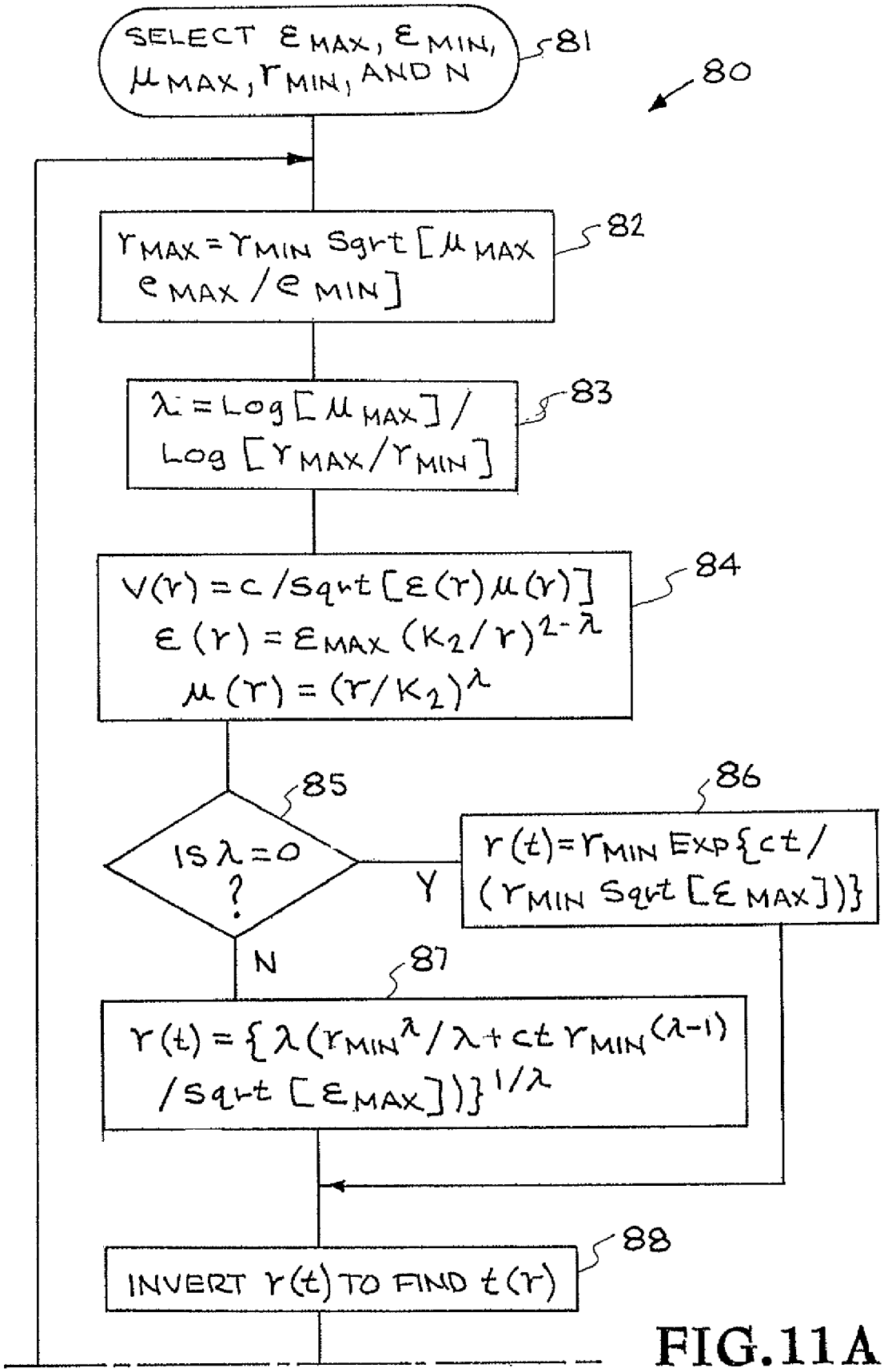
FIGS. 11A-C together show an exemplary flowchart of the method of designing the concentric radial sections to achieve substantially constant characteristic impedance when, for example, relative magnetic permeability and relative dielectric permittivity, are stepwise varied as a step function of radius.
Figure 11B:
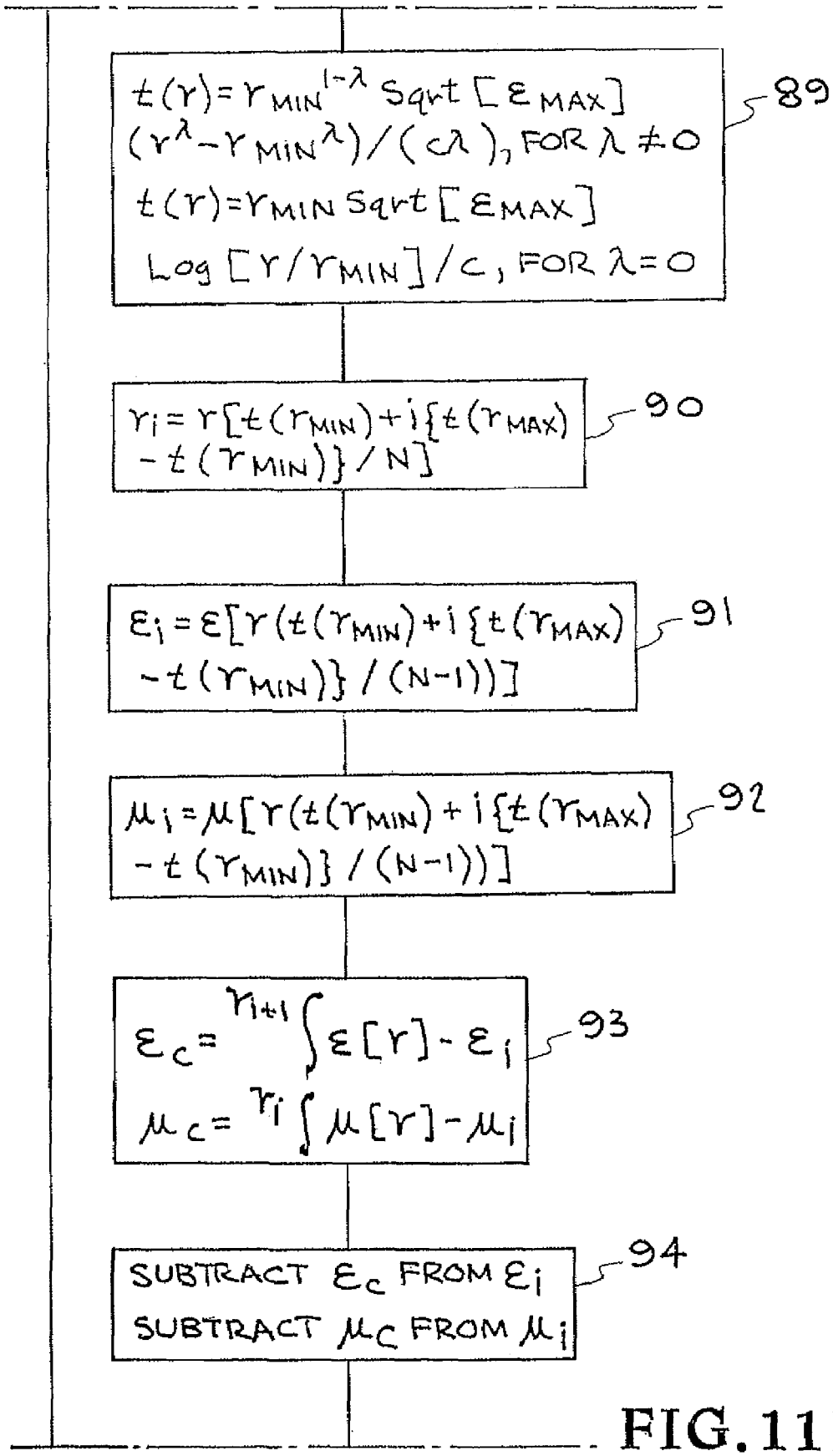
Figure 11C:
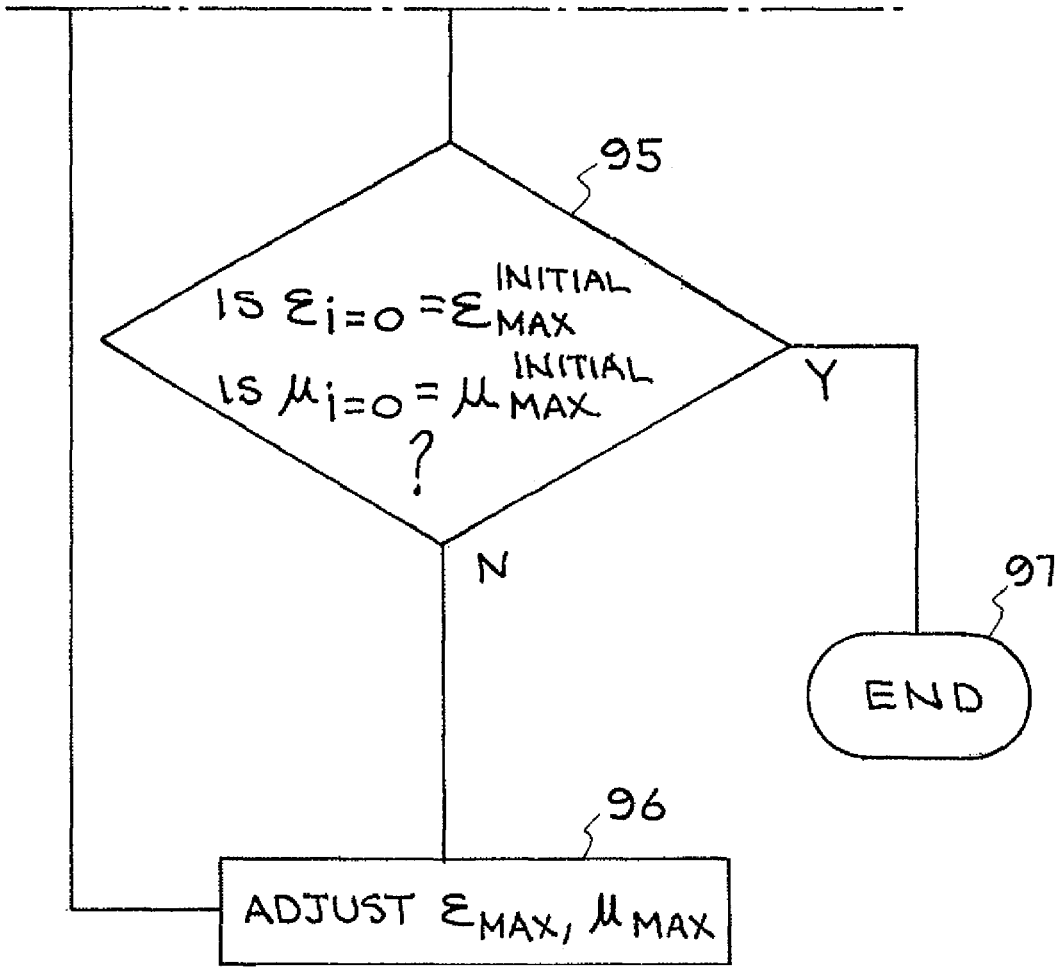

FIGS. 11A-C together show a flow chart of an exemplary embodiment of the present invention by which the radial widths (i.e. wall thickness of a radial section) and the varied material parameters are determined for each of the concentric radial sections. In particular, FIGS. 11A-C illustrate the case where both relative magnetic permeability and relative dielectric permittivity are varied as functions of radius. First in step 81, $\in_{max}$, $\in_{min}$, $\mu_{min}$, $r_{min}$, and N are selected. At steps 82 and 83, $r_{max}$ and $\lambda$ are calculated from the pre-selected known values, and at step 84 the continuous functions of the varied material parameters are chosen. At step 85, depending on the value of the profile constant $\lambda$, two different equations of radius as a function of time may be used, as shown in steps 86 and 87. At step 88, the radius as a function of time is inverted to time as a function of radius. Step 89 shows the resulting two functions of time in radius. Steps 90-92 next calculate the values of the radius, permeability, and permittivity at each of the N+1 points defining the radial sections. The end-point correction takes place at these steps. Next at steps 93 and 94, traversal error correction is performed by setting the integral of the curve above the section's varied material parameter value to be equal to the integral of the curve below the section's varied material parameter value. At step 95, if the initially selected values of the varied material parameters (in this case $\in_{max}$, $\mu_{max}$) are correct, then the algorithm ends at step 97. Otherwise $\mu_{max}$, $\mu_{max}$ are adjusted at step 96 and returned to step 82. Although not shown in the figures, the result of this method would be a set of values for the radial widths and varied material parameters that are provided to a user, such as by displaying on a computer screen or otherwise notifying the user as known in the art.

Figure 7:
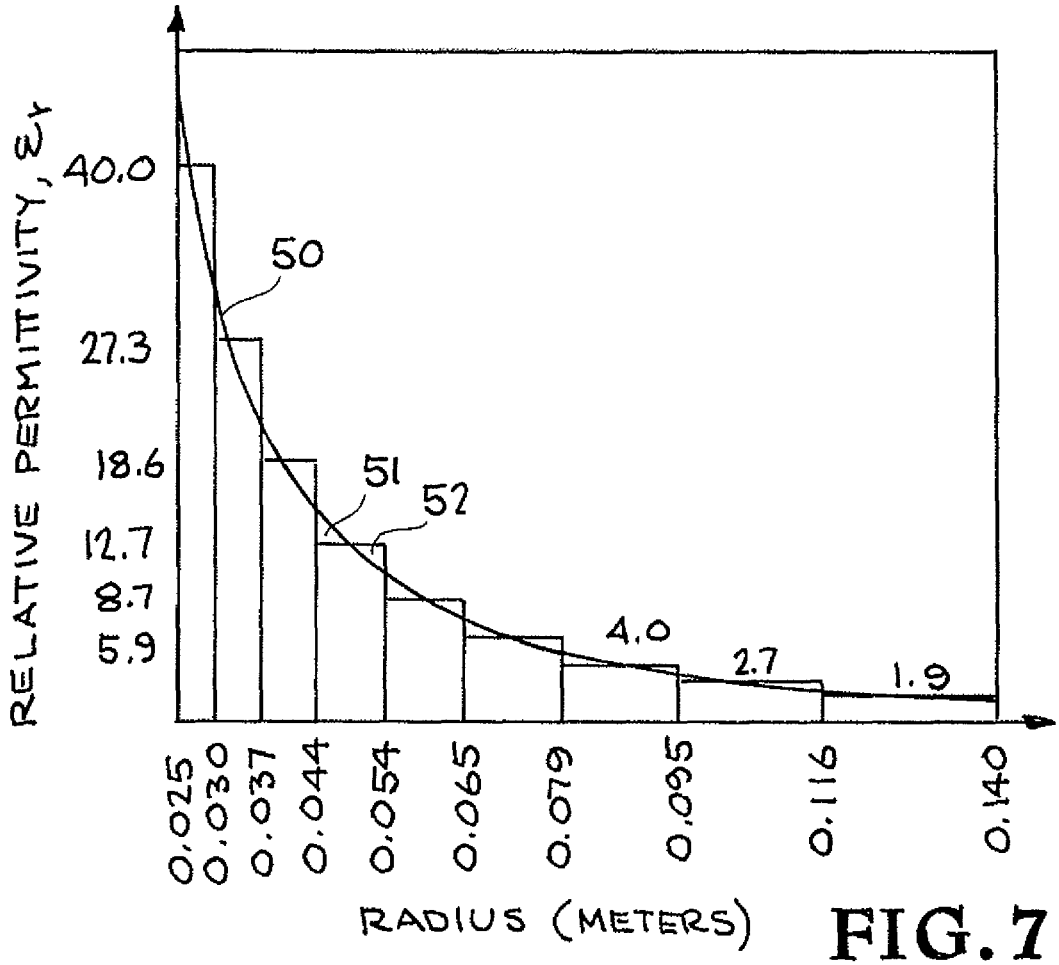
FIG. 7 is a graph, in a first illustrative example, showing the variation of relative permittivity as a continuous function of radius, and discrete concentric radial sections modeled to approximate the continuous function according to the present invention.
Figure 8:
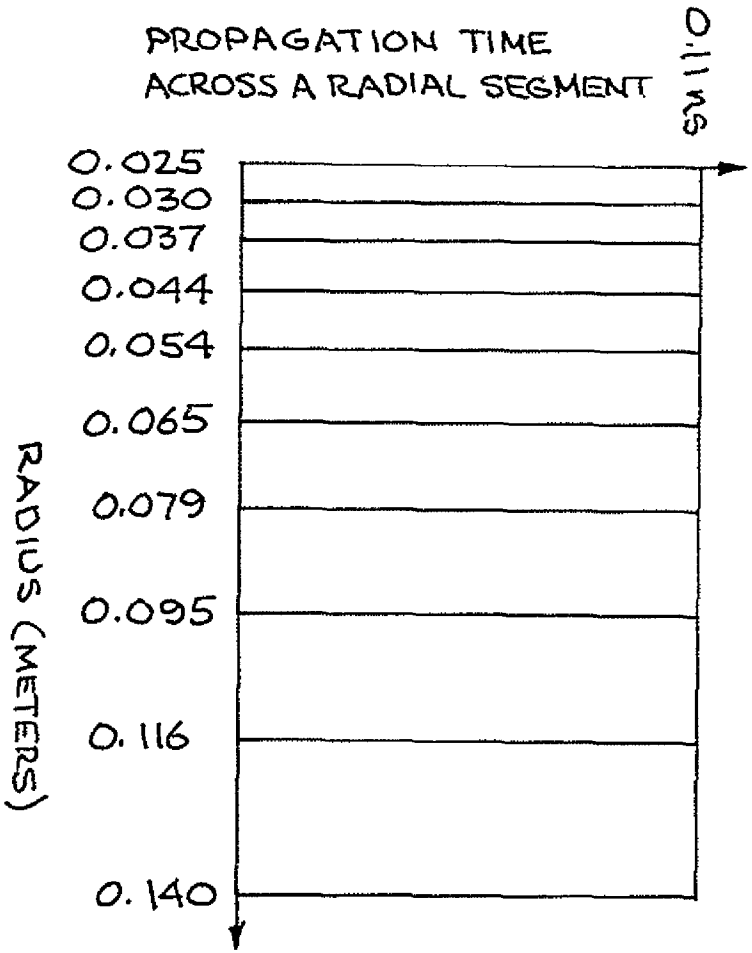
FIG. 8 is a graph, in the first illustrative example, showing the propagation time across the concentric radial sections.
Figure 9:
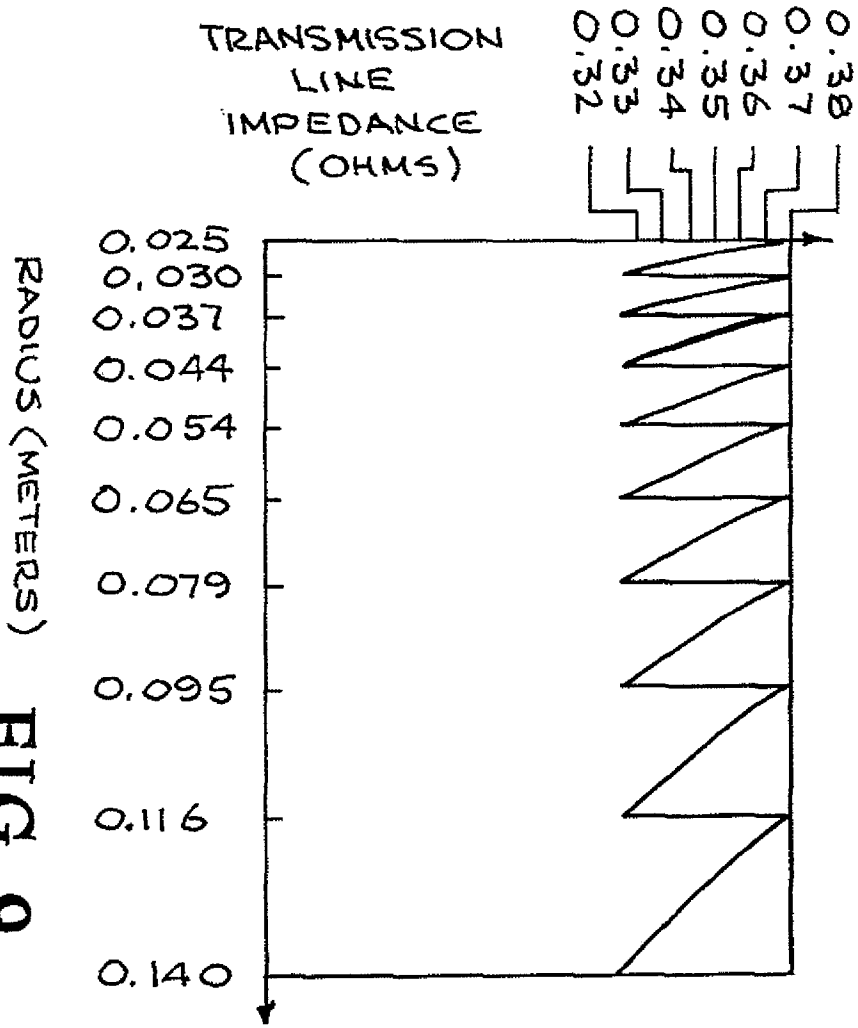
FIG. 9 is a graph, in the first illustrative example, showing the transmission line impedance across the concentric radial sections.

An example illustrating a design of the concentric radial sections produced according to the method of the present invention are shown in FIGS. 7-9 where only relative dielectric permittivity is varied as a step function of radius in a discrete sectional arrangement. It is appreciated however, that other material parameters may also be varied together with or independent of variation of permittivity. In particular, FIG. 7 shows the variation of relative permittivity as a continuous function of radius, and discrete concentric radial sections modeled to approximate the continuous function according to the present invention. In particular, the selected continuous function of relative permittivity is given by:

$$\varepsilon_r(r) = \varepsilon_{max}\left(\frac{a}{r}\right)^2,$$

indicated at reference character 50, so that characteristic impedance is $$Z(r) = \frac{60}{\sqrt{\varepsilon_{max}}}\frac{d}{a},$$

where d is the transmission line thickness (1 mm), r is the radial coordinate, a is the inner radius (25 mm), and c is the speed of light in vacuum. Reference characters 51 and 52 show the integration of the curve 50 above and below, respectively, the varied material parameter value for each radial section, which is used for traversal error correction.

FIG. 8 is a graph, in the first illustrative example, showing the propagation time across the concentric radial sections. In this case, the wave velocity, is $$v(r) = \frac{c}{\sqrt{\varepsilon_r}} = \frac{c}{\sqrt{\varepsilon_{max}}}\frac{r}{a} = \frac{dr}{dt},$$

and the radial position at time t is $$r(t) = ae^{ct/a\sqrt{\varepsilon_{max}}}.$$

Inverting radius as a function of time, to time as a function of radius, you get $$t(r) = \frac{a\sqrt{\varepsilon_{max}}}{c}\ln\left(\frac{r}{a}\right).$$

FIG. 9 is a graph, in the first illustrative example, showing the transmission line impedance across the concentric radial sections. It is appreciated that the while the characteristic impedance in each respective radial section is not constant, the characteristic impedance from section to section is substantially constant, especially given the maximum impedance variation of about 0.06 ohms between the highest and lowest points, (shown enlarged and exaggerated in FIG. 9).

Figure 10:
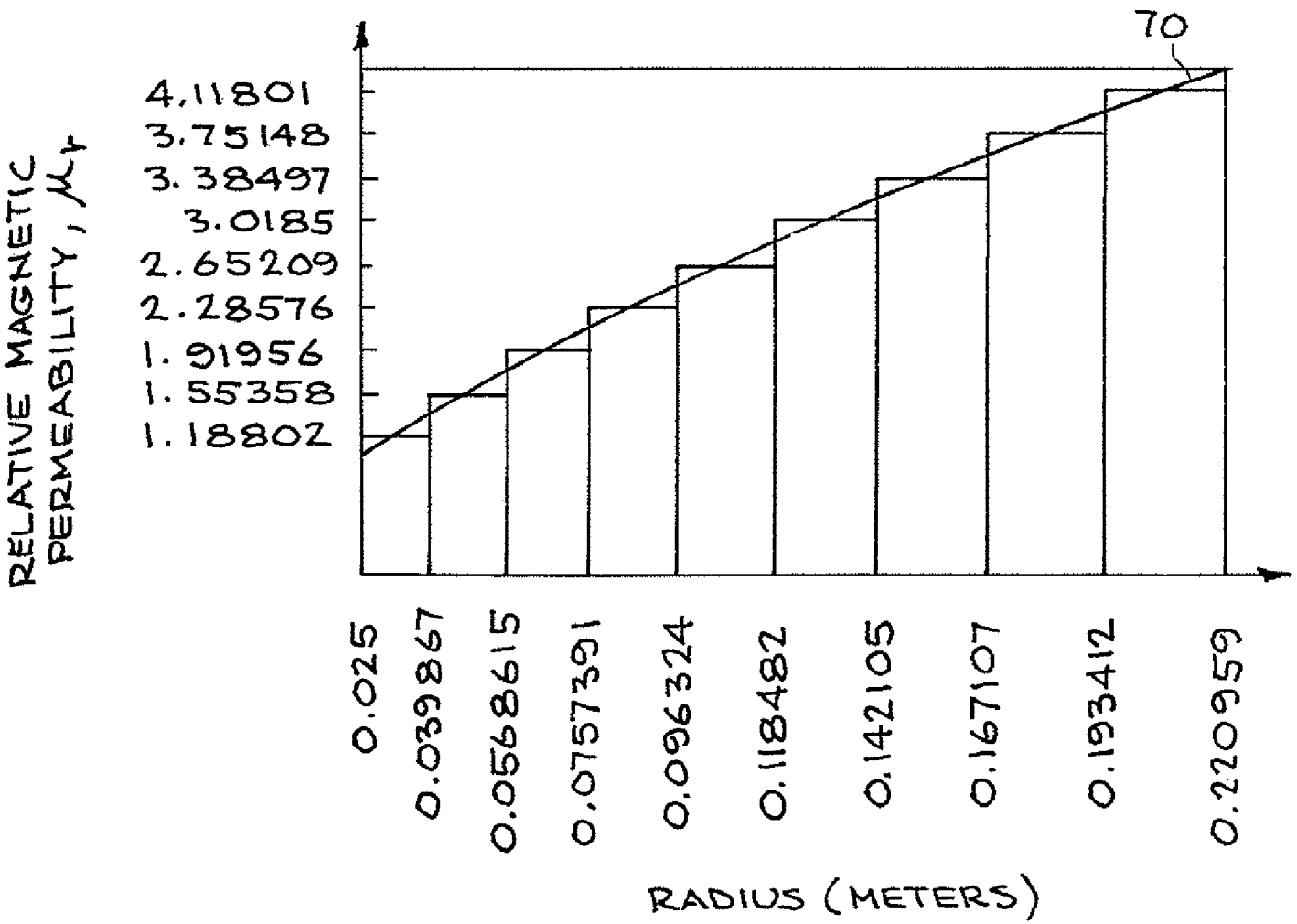
FIG. 10 is a graph showing the variation of relative magnetic permeability as a continuous function of radius, and discrete concentric radial sections modeled to approximate the continuous function according to the present invention.

And FIG. 10 is a graph showing the variation of relative magnetic permeability as a continuous function of radius, and discrete concentric radial sections modeled to approximate the continuous function according to the present invention. In this case, the innermost radial coordinate has a lower relative magnetic permeability than the outermost rational coordinate, as suggested by the slope of the continuous curve.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

We claim:

1. A radial transmission line, comprising:

a first plane conductor having a first central hole;

a second plane conductor spaced from and in parallel with the first plane conductor, and having a second central hole aligned with the first central hole; and an electromagnetically permeable material that fills the space separating the first and second plane conductors to form a central channel connecting the first and second central holes, said material having a material parameter of relative magnetic permeability varied as a function of radius so that the characteristic impedance of the radial transmission line is substantially constant and pulse transmission through the radial transmission line is substantially dispersion-free.

2. The radial transmission line of claim 1, wherein said electromagnetically permeable material comprises a plurality of concentric radial sections, with the relative magnetic permeability constant in each respective section but stepwise varied from section to section as a step function of the radius.

3. The radial transmission line of claim 2, wherein radial widths of the concentric radial sections are dimensioned so that pulse traversal time across each section is the same.

4. The radial transmission line of claim 3, wherein, given a pre-selected continuous curve of relative magnetic permeability as a function of radius, the relative magnetic permeability values of the concentric radial sections are selected so that for each radial section the integral of the curve above the section's permeability value is equal to the integral of the curve below the section's permeability value.

5. The radial transmission line of claim 1, wherein said electromagnetically permeable material has additional material parameters of axial width and relative dielectric permittivity with at least one of the additional material parameters also varied as a function(s) of radius so that the characteristic impedance of the radial transmission line is held substantially constant and pulse transmission through the radial transmission line is substantially dispersion-free.

6. The radial transmission line of claim 5, wherein said electromagnetically permeable material comprises a plurality of concentric radial sections, with the varied one or both of the relative magnetic permeability and the relative dielectric permittivity constant in each respective section but stepwise varied from section to section as a step function of the radius.

7. The radial transmission line of claim 6, wherein radial widths of the concentric radial sections are dimensioned so that pulse traversal time across each section is the same.

8. The radial transmission line of claim 7, wherein, given a pre-selected continuous curve of each varied material parameter(s) as a function of radius, the varied material parameter values of the concentric radial sections are selected so that for each radial section the integral of the curve above the section's varied material parameter value is equal to the integral of the curve below the section's varied material parameter value.

9. The radial transmission line of claim 1, wherein the relative magnetic permeability $\mu(r)$ is varied as a function of radius (r) according to $\mu(r)=kr^2$ where k is a constant, while the relative dielectric permittivity $\in$ and the axial width $\omega$ are constant, so that the characteristic impedance Z(r) is defined by $$Z(r) = 60\sqrt{\frac{k}{\varepsilon}}\,w.$$

10. A radial transmission line, comprising:

a first plane conductor having a first central hole;

a second plane conductor spaced from and in parallel with the first plane conductor, and having a second central hole aligned with the first central hole; and an electromagnetically permeable material that fills the space separating the first and second plane conductors to form a central channel connecting the first and second central holes, said material comprising a plurality of concentric radial sections having material parameters of relative magnetic permeability μ, relative dielectric permittivity ∈, and axial width ω, with at least one of the material parameters constant in each respective section but stepwise varied from section to section as a step function of radius r, so that the characteristic impedance Z(r) of the radial transmission line is substantially constant according to $$Z(r) = 60\sqrt{\frac{\mu(r)}{\varepsilon(r)}}\,\frac{w(r)}{r},$$

and pulse transmission through the radial transmission line is substantially dispersion-free.

11. The radial transmission line of claim 10, wherein radial widths of the concentric radial sections are dimensioned so that pulse traversal time across each section is the same.

12. The radial transmission line of claim 11, wherein, given a pre-selected continuous curve of each varied material parameter(s) as a function of radius, the varied material parameter values of the concentric radial sections are selected so that for each radial section the integral of the curve above the section's varied material parameter value is equal to the integral of the curve below the section's varied material parameter value.

* * * * *